US008800892B2

(12) United States Patent
Prenzler

(10) Patent No.: US 8,800,892 B2
(45) Date of Patent: Aug. 12, 2014

(54) REGULATING DEVICE FOR A WATER OUTFLOW, PARTICULARLY FROM SANITARY FITTINGS

(76) Inventor: Klaus Prenzler, Wietze (DE)

( * ) Notice: Subject to any disclaimer, the term of this patent is extended or adjusted under 35 U.S.C. 154(b) by 569 days.

(21) Appl. No.: 13/060,068

(22) PCT Filed: Sep. 1, 2009

(86) PCT No.: PCT/EP2009/061280

§ 371 (c)(1),
(2), (4) Date: Apr. 18, 2011

(87) PCT Pub. No.: WO2010/023328

PCT Pub. Date: Mar. 4, 2010

(65) Prior Publication Data

US 2011/0303309 A1 Dec. 15, 2011

(30) Foreign Application Priority Data

Sep. 1, 2008 (DE) ..... 10 2008 045 114
Oct. 7, 2008 (DE) ..... 10 2008 050 247

(51) Int. Cl.

| | |
|---|---|
| ***E03C 1/08*** | (2006.01) |
| ***B05B 7/06*** | (2006.01) |
| ***B05B 15/00*** | (2006.01) |
| ***B05B 1/14*** | (2006.01) |

(52) U.S. Cl.
USPC ..... 239/428.5; 239/430; 239/538; 239/539; 239/540; 239/590.5

(58) Field of Classification Search
USPC ..... 239/428.5, 432, 590, 590.5, 582.1, 239/581.2, 538–540, 580, 513–514, 462, 239/575, DIG. 23
See application file for complete search history.

(56) References Cited

U.S. PATENT DOCUMENTS

| | | | | | |
|---|---|---|---|---|---|
| 2,458,118 | A | * | 1/1949 | Tursky | 210/494.1 |
| 2,639,194 | A | * | 5/1953 | Wahlin | 239/533.15 |
| 3,822,040 | A | * | 7/1974 | Hibbard | 239/86 |
| 3,884,418 | A | * | 5/1975 | Ritzenthaler et al. | 239/428.5 |
| 3,902,671 | A | * | 9/1975 | Symmons | 239/428.5 |

(Continued)

FOREIGN PATENT DOCUMENTS

| | | | | |
|---|---|---|---|---|
| CH | 315823 | * | 8/1953 | B05B 7/04 |
| CH | 315823 | | 9/1956 | |

(Continued)

*Primary Examiner* — Len Tran
*Assistant Examiner* — Alexander M. Valvis
(74) *Attorney, Agent, or Firm* — Salter & Michaelson

(57) ABSTRACT

A regulating device for a water outflow, in particular of sanitary fittings, comprises a cylindrical sleeve with a central cylinder axis. The sleeve is adapted for attachment to or in the water outflow. A support plate is disposed perpendicular with respect to the axis of the sleeve. A throttling and regulating element can rotate relative to the support plate about the axis and can move in the direction of the axis. By way of the throttling and regulating element, water can flow through from one side of the support plate to the other side of the support plate. The throttling and regulating element comprises a device for fine throttling of the water. An annular distribution space for the water is delimited by the support plate, the sleeve and the throttling and regulating element. In the distribution space, water can flow in from openings in the throttling and regulating element. In the distribution space, water can flow out of the sleeve to a water outlet.

18 Claims, 7 Drawing Sheets

(56) References Cited

U.S. PATENT DOCUMENTS

| | | | | | |
|---|---|---|---|---|---|
| 4,082,225 | A | * | 4/1978 | Haynes | 239/428.5 |
| 4,131,234 | A | * | 12/1978 | Pescetto | 239/457 |
| 4,166,576 | A | * | 9/1979 | Harrison | 239/11 |
| 4,189,099 | A | * | 2/1980 | Bruninga | 239/200 |
| 4,322,292 | A | * | 3/1982 | Knox | 239/428.5 |
| 4,346,844 | A | * | 8/1982 | Harmony | 239/381 |
| 4,477,026 | A | * | 10/1984 | Lockwood | 239/428.5 |
| 4,582,253 | A | * | 4/1986 | Gerdes | 239/1 |
| 4,640,461 | A | * | 2/1987 | Williams | 239/317 |
| 4,655,394 | A | * | 4/1987 | Ferrazza et al. | 239/412 |
| 4,752,031 | A | * | 6/1988 | Merrick | 239/193 |
| 4,790,481 | A | * | 12/1988 | Ray et al. | 239/204 |
| 5,071,071 | A | * | 12/1991 | Chao | 239/428.5 |
| 5,095,558 | A | * | 3/1992 | Howard | 4/541.6 |
| 5,348,231 | A | * | 9/1994 | Arnold et al. | 239/428.5 |
| 5,467,929 | A | * | 11/1995 | Bosio | 239/428.5 |
| 5,615,836 | A | * | 4/1997 | Graef | 239/428.5 |
| 5,833,143 | A | * | 11/1998 | Hsin-Fa | 239/456 |
| 6,708,902 | B2 | * | 3/2004 | Takeshi et al. | 239/428.5 |
| 6,732,956 | B1 | * | 5/2004 | Chetrit et al. | 239/428.5 |
| 2006/0163386 | A1 | * | 7/2006 | Weis et al. | 239/428.5 |

FOREIGN PATENT DOCUMENTS

| | | | | |
|---|---|---|---|---|
| DE | 35 10 107 | | 10/1985 | |
| DE | 42 03 576 | | 8/1993 | |
| DE | 43 10 738 | | 10/1994 | |
| DE | WO2006005099 | * | 7/2005 | E03C 1/084 |
| EP | 0 693 970 | | 1/1996 | |
| EP | 1 933 217 | | 6/2008 | |
| FR | 2 479 018 | | 10/1981 | |
| WO | 2006/005099 | | 1/2006 | |

* cited by examiner 36
41
37
11
40

60
33
20
51
63
46

11
32
31
23
25
31
21
90
20
36
64
24
38
41
42
22
37
91
12
51
40
13
47
30
14
60
63
46
33

11
31
31
32
23
25
90
20
21
24
64
38
41
22
42
37
12
91
51
40
13
30
47
14
60
46
63
33

REGULATING DEVICE FOR A WATER OUTFLOW, PARTICULARLY FROM SANITARY FITTINGS

TECHNICAL FIELD

The invention relates to a regulating device for a water outflow, particularly from sanitary fittings.

BACKGROUND OF THE INVENTION

Sanitary fittings possess, for example, water faucets with water outflows or other possibilities for allowing a user to obtain water. These types of water outflows provide a jet of water, the intensity of which and thus the quantity of flow per unit of time is adjusted by the user in a suitable way according to his needs. In this way, the user can manage the water jet pattern that the water flowing out of the water outflow offers to him.

The increasing awareness of the environment, on the one hand, and the rising costs for drinking water, on the other hand, have led to the circumstance that consumers have become increasingly interested in the question of water consumption. Every consumer and user is interested in consuming no more water than appears necessary or meaningful for a specific application purpose. At the same time, however, consumers and users would also like drinking water to be reliably available from the sanitary fixture in the necessary quantity and quality and thus fulfill its task. The water jet pattern shall also be optically pleasing and regular.

The question of water consumption is particularly essential in those places where drinking water or water for industrial use is relatively costly or only available in limited quantities, such as, for example, on board ships or other means of transport. Also, in those places where relatively large quantities of drinking water are regularly required and thus economically lead to considerable costs, this question plays a role, e.g., in the hotel field or in places where many people frequently wash their hands, e.g., in restaurants, swimming pools, hospitals and comparable facilities.

There is thus a considerable interest in making available the water exiting the water outflow to consumers and users in a particularly effective and useful manner.

A showerhead for this purpose is proposed in DE 35 10 107 C2. It possesses a nozzle piece with a housing, into which a spindle holder is inserted. A threaded borehole with an adjusting spindle screwed therein is found in the spindle holder. A blind borehole from which distributor channels are guided toward the outside is found in the adjusting spindle. Water flows into blind borehole 1 and from here flows out again via the lateral distributor channels. The distributor channels are closed to a varying degree, each time depending on the screwed-in depth of the adjusting spindle.

In this way, it is possible to establish a specific maximum discharge quantity by means of an adjustment produced once. By integrating the adjustable elements inside the nozzle piece, the circumstance is avoided that users may cause damage to the adjustability or disrupt the entire system due to a manual control.

Such a nozzle piece cannot be used for the intended purpose as a regulator of the water jet. For technical reasons, such a nozzle piece must be constructed with bushings, which leads to a considerable structural length of 50 mm. Such a design is no longer sufficient for today's requirements.

Another possibility, which is frequently desired with these types of nozzle pieces, is the possibility of mixing the outflowing liquid with air. Such a nozzle piece has already been proposed in CH Patent 315,823, in which a part that has a nozzle opening is inserted. A perforated hollow cone with its tip directed toward the nozzle opening is disposed coaxially to the nozzle opening. The space surrounding the hollow cone is connected to the external air. This leads to the circumstance that air is aspirated from the outside by the jet of liquid exiting the nozzle opening and divided by the hollow cone. Together with the liquid, this air is guided into the cone's inside space, which is joined to the outlet of the nozzle piece. A mixture of liquid and air is formed there. Due to the air in the liquid jet, the overall jet is several times larger than it would be without this aeration for an equally large consumption of liquid.

It is a disadvantage with such designs that the quantity ratios cannot be modified and also considerable depositions can build up on the inside.

At the present time, in many fields of application, such an intense aeration of the water jet of a water jet regulator is viewed as critical. In the case of water outflows in sensitive fields, such as in operating or operating prep rooms, in nurseries, in nursing homes, and also in all health-care facilities, it is increasingly desired to avoid aerosol formation. Aerosol formation in and at water outflows increases the risk of a *Legionella* infection. Conventional water jet regulators thus have the problem that, on the one hand, an aeration is desired in certain cases of application, but on the other hand, this aeration is to be absolutely avoided in other cases of application. These desires that are diametrically opposed to one another in the case of outflow fittings of sanitary facilities could not previously be fulfilled at the same time. Therefore, several variants of nozzle pieces or showerheads or similar devices must be provided for different cases of application, in order to be able to satisfy all requirements.

Even the question of metering of the water jet in outlet fittings has still not been worked out and leads to various proposals.

For these types of objectives, EP 0 693 970 B1 describes a water jet regulator and flow limiter for sanitary fittings. The corresponding product is also often used successfully in practice as an accessory part for sanitary fittings. The flow quantity at water outflows during use is optimally metered. Here, a device that divides the water jet, this device having a throttle plate and a cylindrical perforate plate forming a distributor space between them, is provided in a housing. The quantity of water that has already been pre-throttled by the cylindrical perforate plate is guided further to the consumer, the cylindrical perforate plate containing a device for fine throttling of the quantity of water. Downstream of the cylindrical perforate plate is also disposed a closed, annular helical spring, which performs a fine distribution of the water flowing through and the latter can appear to be an ordered water jet in the view of the user. The jet pattern is closed, but finely distributed.

The different metering possibilities and the ultrafine distribution ensure that for the consumer, the washing objective can be completely fulfilled not only sensitively, but also effectively, with an optimized, reduced quantity of water. The different adjusting possibilities make it possible for the installation to adapt a quantity of water from the sanitary fixture roughly measured to its dimensions, to the ratios that are present at the respective application site, for example, a sink, and to the local pressure ratios, so that by actuating the fittings provided on the sink, the user can then obtain an adjustment that is precisely adapted to his currently existing requirements. Usually, the user no longer changes the adjustment of the water jet regulator itself.

These often used and well proven regulating devices function at the usual water outflows or outlets of sanitary fittings. In each case, they fit into a specific water outlet and are constructed so that they can be mounted in or at this water outlet. Of course, over the course of the last few years, for technical reasons, but still more for purposes of a more modern design, new constructions for the water outlets of fittings have continually been introduced on the sanitary market. In the meantime, there are water outlets with very different diameters and also with different threaded uptakes, by means of which standard, not yet optimized water outlet elements can be incorporated in the water outlets.

The usual inner diameter of previous conventional water outlets is approximately 22 mm or 24 mm diameter. Other diameters appear with the increasingly widespread use of so-called design fittings. The trend shows that water outlets tend to have continually smaller diameters, whereby even diameters in the range of 14 mm or 16 mm can be achieved realistically.

There are also water outlets that do not possess a thread uptake inside, but have another type of fastening possibility.

This means that the regulating devices according to EP 0 693 970 B1 must be kept in stock in a plurality of different embodiments, in order to be able to incorporate these accessory parts into the respective different types of water outlets.

Costs and development expenses are increased thereby, since a new regulating device must be developed, produced and kept in stock for each water outlet coming onto the market and each new diameter of sanitary fittings.

It would be desirable if expenses for these could be reduced.

Therefore, it is a problem of the present invention to present a proposal for a regulating device for a water outflow, in particular, from sanitary fittings, by means of which the increasing costs of continuously new development of additional embodiments can be counteracted.

SUMMARY OF THE INVENTION

The problem is solved by a regulating device for a water outflow, particularly from sanitary fittings, having a cylindrical sleeve with a central axis of the cylinder, this sleeve being formed for introduction at or in the water outflow, having a bearing plate disposed perpendicular to the axis of the sleeve, having a throttling and regulating element that can be rotated around the axis relative to the bearing plate and can be moved in the direction of the axis, by means of which water can flow from one side of the bearing plate to the other side of the bearing plate, whereby the throttling and regulating element has a device for the fine throttling of water, and having an annular distributor space for water, which is delimited by the bearing plate, the sleeve and the throttling and regulating element, into which water can flow from openings in the throttling and regulating element and from which water can flow out from the sleeve to a water outlet.

The costs of a regulating device for water outflows that will be used for different fittings on the sanitary market, can be clearly reduced with this type of design. That is, it is possible by means of the invention to always keep the core region with the essential technical elements the same for each embodiment, and only to provide a change in the sleeve that is used each time, in addition to connecting threads introduced thereon for mounting in the water outlet, with the bearing plate preferably formed in one piece with the sleeve, as well as the optional additional perforate plate.

These elements, which make possible a mounting on the water outlet and, for example, can appear different for any diameter or also for any internal thread of the water outlet, in fact occupy an essential space from the view of the impartial observer and for the view of the overall regulating device from the outside, but are only of secondary importance for the costs of the total regulating device. This sleeve as well as the optional perforate plate are newly adapted and produced for every new sanitary outlet that is introduced on the market, whereas the technically functionally more important and more expensive main components of the regulating device according to the invention are always identical and thus can be manufactured in much larger production series and quantities.

It is particularly preferred if a metering of an additional amount of air from the sleeve into the water jet in the water outlet can be adjusted, by moving the throttling and regulating element in the axial direction. In a preferred embodiment of the invention, there is also the possibility to continuously adjust a desired aeration of the exiting water jet.

This is particularly achieved by the circumstance that separate adjusting possibilities for introducing air and for introducing water are provided in the axial direction.

In this case, it is particularly interesting if the device for the fine throttling of water is provided underneath cross boreholes in star formation, and if the cross boreholes introduced directly above the perforate plate are closed by throttling by means of the device.

Thus the above-mentioned problem can also be taken into consideration, that, on the one hand, there are cases of application in which an aeration is very much desired, but, on the other hand, there also are cases where this aeration must be completely avoided. Finally, the degree of aeration is also of interest for different cases of application in various form.

In all of these cases of application, one and the same construction can now be used. That is, it is now possible to decide at the site of application whether there should be an aeration and how intense this aeration should be, and then to set this adjustment. For this, several alternatives or variants now no longer need to be readily available for this task; an adjustment on site can simply be made.

In this way, inventories will be further reduced and only a few manufacturing series will still be required.

In a preferred embodiment, the already mentioned perforate plate is designed in one piece with the throttling and regulating element. For a plurality of embodiments, it is therefore possible to provide a constant outer diameter of the perforate plate, although water outlets possess different configurations. By different designs of the wall thickness of the sleeve, however, it is possible to work with an unmodified perforate plate by keeping constant the inner diameter of the sleeve, at least in the region where the perforate plate is applied to the sleeve from inside. Then, in order to adapt to different shapes and diameters of water outlets, the wall thickness of the sleeve can be selected differently, corresponding to its outer thread, or also the corresponding length in the axial direction can be selected differently.

The sleeve is then made equivalent to the different inner diameters of water outlets by employing a different wall thickness. The inner diameter of the sleeve is kept constant for all embodiments, while the wall thickness varies to the extent necessary for the respective water outlet.

This may, of course, lead to the fact that the sleeve has a very considerable wall thickness. This is not a problem, however, since a comparatively cost-effective material can be selected for the sleeve.

There may also be sleeves without an outer thread, but with other possibilities and adaptations of the shape to the inner shape of the water outlet. Nevertheless, for every embodiment, the costly inner part of the entire device is identical.

Thus, the throttling and regulating element that is constructed in a complicated and technically demanding manner, can be produced in a large number of pieces, and therefore a cost-effective production is provided, whereby this type of throttling and regulating element can be combined with a plurality of different sleeves.

In this way, the majority of water outlets relevant in practice can for the most part be provided with one and the same throttling and regulating element in a practical manner with the accessory parts according to the invention. Then, for extreme diameters, a different shape of the throttling and regulating element that is to be manufactured can be provided separately, and this design in turn can then be used for several such water outlets with extreme diameters, so that at least a clear cost reduction ensues.

Therefore, accessory parts for sanitary fittings that serve as flow limiters, throttling devices and also as retaining or guiding units for the water jet are also created with these regulating devices according to the invention. They make it possible to adjust and to optimize the quantity of water flow.

In another embodiment of the invention, in contrast, other requirements are taken into consideration. In hygienically sensitive areas, for example, in hospitals or in health-care facilities, an aeration of the water jet is not desired and is thus omitted. A contamination is also avoided in this way. Here, silvered surfaces can be used and, for example, a fine silver star containing 99.8% silver fraction can be used.

As tests have already shown, a formation of mucilaginous surfaces, thus so-called biofilms, is completely avoided in these sleeves.

A preferred embodiment is particularly characterized in that recesses in the form of a serration are disposed on the inside at the end of the sleeve that is adjacent to the water outlet, that proceeding from the perforate plate, a hollow cylinder symmetrical to the axis extends in the direction of the water outlet, that another recess is provided between the hollow cylinder and the inner wall of the sleeve, that radially running boreholes extend through the hollow cylinder, and that a path for aeration into the flowing water is blocked off or freed up by the axis-parallel movement of the perforate plate with the hollow cylinder, by means of the recesses of the serration and the additional recess through the boreholes.

With this type of embodiment, it is possible to precisely adjust whether air will be mixed in with the flowing water and optionally how much air will be mixed in, by means of moving the throttling and regulating element relative to the sleeve with the bearing plate. With an appropriate adjustment, the water* can then penetrate into the space between the inside of the sleeve and the hollow cylinder through the recesses or the serration, and can enter into the flowing water through the boreholes in the hollow cylinder.

*sic; the air? —Translator's note.

However, if the relative position of the throttling and regulating element is such that the path of the air through the recesses in the sleeve into the intermediate space between the inside of the sleeve and the hollow cylinder is blocked, no air can enter.

This means that one and the same design can be used both in hospitals, where an aeration is not desired, and in hotels, for example, where an aeration is very much desired in many cases. The appropriate adjustment can be performed very simply during the installation of the regulating device, since this would correspond to the respective application site. It is no longer necessary to keep different regulating devices in stock for two different designs.

The serration of the recesses at the lower opening of the sleeve can be additionally designed to be a fitting for a tool and this can be utilized in order to engage with a tool and to actuate the sleeve in order to mount it, for example, in a water outlet, e.g., to screw it in. A special tool can be used for this, which the installer can use. Without such a special tool, an unauthorized person cannot dismantle the regulating device or cannot falsely adjust it.

An extending of the recesses, thus of the serration, on the inside of the sleeve in the direction of the bearing plate also is of advantage when a continuous aeration of the water jet is advantageous. The serration can then act in a stabilizing manner for the water jet also by means of its shape.

In all embodiments, maintenance and cleaning operations can be rapidly and simply conducted. This is supported by the fact that all components are autoclavable. The maintenance cycles can be extended significantly due to the very hygienic design of all embodiments.

By means of the invention, the possibility is created to increase individual advantages and comfort, even in the most modern and newest types of fixture outlets.

By means of the invention, a parallel and continuous regulation of the air or the aeration is possible for the likewise continuously adjusted quantity of water, in fact, an aeration from zero up to a maximum aeration. All of this can be provided by a vertical adjustment of the throttling and regulating element, and, in fact, very simply with Allen wrenches, which engage in the corresponding recesses.

Preferably, the regulation of the air, on the one hand, and of the water, on the other hand, is carried out with two different Allen wrenches, thus with two Allen wrenches of different diameter, which are arranged axially one over the other, each one independent of the other. The separate and independent adjustment of the aeration and the adjustment of the water quantity by means of two very simple Allen wrenches from below has enormous advantages and has not yet been executed in any design.

DESCRIPTION OF THE DRAWINGS

The invention is explained in more detail below in the drawing on the basis of several embodiment examples. Here.

DETAILED DESCRIPTION

The different embodiments in the figures show an accessory part for sanitary fittings. The accessory part can be introduced into a water outlet (not shown) of a sanitary fixture. It serves for the purpose of regulating water 10 flowing through this water outlet.

Figure 1:
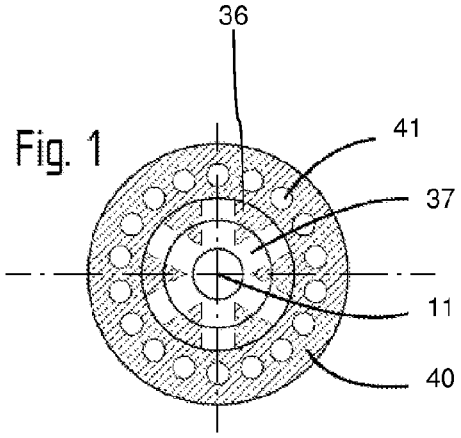
FIG. 1 shows a plan view onto a first embodiment of the invention, viewed in the direction of the water outflow.

A view that shows a water inlet opening 11 in the direction of water 10 is presented in FIG. 1. Water 10 thus flows perpendicular to the plane of the figure into this water inlet opening 11 and is there distributed into different horizontal planes, which will be explained in more detail in connection with the other figures.

Figure 2:
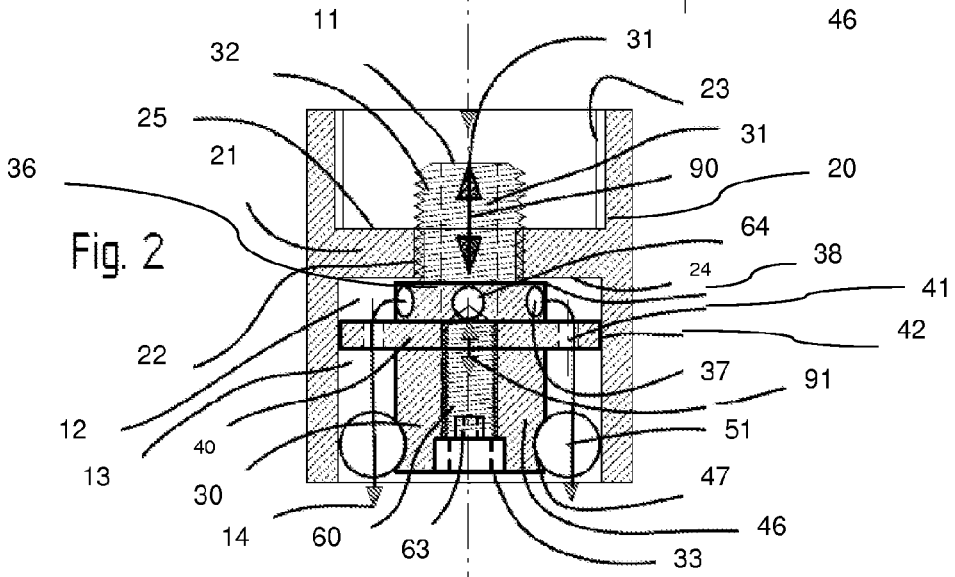
FIG. 2 shows a section through the embodiment of FIG. 1.

A section along the axis of the embodiment of FIG. 1 is shown in FIG. 2, in which water 10 flows from above into water inlet opening 11.

A sleeve 20 possesses a cylindrical form and can be mounted by its outer side in or at a water outlet of a sanitary fixture. Sleeve 20 has a bearing plate 21, which is disposed perpendicular to the axis of cylindrical sleeve 20 and is preferably designed in one piece with sleeve 20. Bearing plate 21 is provided with a through borehole in the center. The through borehole has an inner thread 22.

A throttling and regulating element 30 is found in the borehole with inner thread 22. This throttling and regulating element has an outer thread 32, which cooperates with inner thread 22 of sleeve 20.

Throttling and regulating element 30 can be rotated in bearing plate 21, whereby inner thread 22 of sleeve 20 and outer thread 32 of throttling and regulating element 30 rotate relative to one another. In order to be able to carry out this rotation, a hexagon socket 33 of throttling and regulating element 30 can be recognized at the lower end of the sectional view. A corresponding hexagon tool can be inserted into this hexagon socket 33 by the installer. If throttling and regulating element 30 rotates relative to sleeve 20 in this form, throttling and regulating element 30 moves vertically up and down in FIG. 2 relative to bearing plate 21 of sleeve 20, which is explained further in connection with FIG. 4.

Throttling and regulating element 30 in turn has a through central borehole 31. Water inlet opening 11, which has already been mentioned in connection with FIG. 1, leads to this central borehole 31.

Underneath bearing plate 21, throttling and regulating element 30 continues with an axial-symmetric plate 36, which has cross boreholes 37 radially pointing outward in a star-shaped pattern.

Beneath this plate 36 is found a perforate plate 40, which is provided with a plurality of axis-parallel, but equidistant circular boreholes 41 provided adjacent to the periphery.

The diameter of perforate plate 40 is so large that it reaches by its outer periphery the inner wall of sleeve 20 and terminates moveably with the latter, but for the most part ends close by. Perforate plate 40, on the one hand, can rotate opposite sleeve 20, since perforate plate 40 can be rotated together with throttling and regulating element 30 as described above, and, on the other hand, it is also mutually moveable in the axial direction, due to the interaction of inner thread 22 of sleeve 20 with outer thread 32 of throttling and regulating element 30. The inner surface of sleeve 20 and the outer surface of perforate plate 40 together form an annular guide region 42.

Beneath perforate plate 40 with circular boreholes 41, throttling and regulating element 30 continues cylindrically, whereby the outer diameter corresponds approximately to that of plate 36 with cross boreholes 37 disposed in star formation.

This cylindrical region of throttling and regulating element 30 thus transitions into a cylinder shaft 46 underneath perforate plate 40 with its circular boreholes 41.

Shaft 46 of throttling and regulating element 30 extends axially approximately as far as sleeve 20.

In the region in which sleeve 20 and throttling and regulating element 30 terminate downstream, an encircling circular groove 47 is provided in throttling and regulating element 30. A spring 51 is disposed in this circular groove, and in fact in the form of a flat spiral spring 51 which is closed and runs around the entire periphery of throttling and regulating element 30. As will be explained further below, here water 10 flows through flat spiral spring 51, which forms a water outlet 14 from the arrangement according to the invention.

As can be well seen in FIG. 2, an encircling annular space or distributor space 12, which is inwardly delimited by plate 36 and outwardly delimited by the inner wall of sleeve 20, forms between bearing plate 21 of sleeve 20 and perforate plate 40 of throttling and regulating element 30.

Beneath perforate plate 40 is formed another annular space or also damming or retaining space 13, which is inwardly delimited by shaft 46 of throttling and regulating element 30 that passes through here and outwardly by the inner wall of sleeve 20. In the axial direction, it is delimited here on top, as mentioned, by perforate plate 40, and on the bottom by flat spiral spring 51 in circular groove 47.

A regulating screw 60 can be screwed into central borehole 31 of throttling and regulating element 30 opposite to the inflow direction of water 10. This regulating screw 60 projects into this central borehole 31 through perforate plate 40 up to the region of plate 36 with cross boreholes 37 in star formation.

Regulating screw 60 has a hexagon socket 63. Hexagon socket 63 serves for the purpose of being able to move regulating screw 60 up or down in central borehole 31 of throttling and regulating element 30 by rotating regulating screw 60. In this way, a fine adjustment of the precise position of regulating screw 60 is possible. That is, the latter projects by its tip directed upward in the view of FIG. 2 up to the region of plate 36 with cross boreholes 37 in star formation. Thus, by fine adjustment, the speed or intensity of water 10 flowing down into central borehole 31 can be precisely adjusted by deflection into cross boreholes 37 in star formation in order to reach distributor space 12.

Now, if one considers the course of water 10 through the entire arrangement, then this water first flows through water inlet opening 11 into central borehole 31 of throttling and regulating element 30 and from there down to plate 36 with cross boreholes 37 in star formation. Further flow through central borehole 31 is stopped here by regulating screw 60 which is screwed in from the opposite side. Water 10 thus continues to flow through cross boreholes 37 in star formation into distributor space 12. There, water 10 is again deflected at a right angle and flows in an axis-parallel manner through circular boreholes 41 of perforate plate 40 into retaining space 13 and from there through flat spiral spring 51 parallel to the wall of sleeve 20 of the arrangement in water outlet 14. A fine distribution of the water as an out-flowing, ordered water jet is produced by flat spiral spring 51.

In this embodiment, plate 36, perforate plate 40 and cylinder shaft 46 with circular groove 47 are formed in one piece with throttling and regulating element 30. Flat spiral spring 51 serves as a retaining and guiding unit for the exiting water jet.

Figure 3:
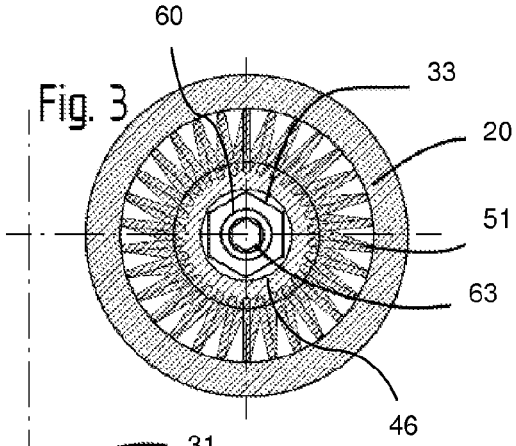
FIG. 3 shows a plan view onto the embodiment of FIGS. 1 and 2, viewed in the direction opposite that of FIG. 1.

The embodiment of FIG. 1 is seen in FIG. 3, viewed from below. Consequently, one views from outside onto the encircling cylindrical wall of sleeve 20.

Flat spiral spring 51 inwardly connects thereto and further on the inside to cylinder shaft 46 of throttling and regulating element 30.

Hexagon socket 33 is disposed inside cylinder shaft 46 of throttling and regulating element 30. The hexagon socket can be engaged during installation so as to rotate the entire throttling and regulating element 30 relative to bearing plate 21 of sleeve 20. By means of inner thread 22 in bearing plate 21, the entire throttling and regulating element 30 is moved in the axial direction by this rotation, as indicated by arrows 90 in FIGS. 2 and 4.

Regulating screw 60 is seen inside hexagon socket 33. As can be seen from FIG. 2, this screw is placed deep inside. Inside the periphery of regulating screw 60 can be recognized a hexagon socket 63; from this side, an installer can engage a tool in this smaller hexagon in order to rotate regulating screw 60 relative to throttling and regulating element 30.

Figure 4:
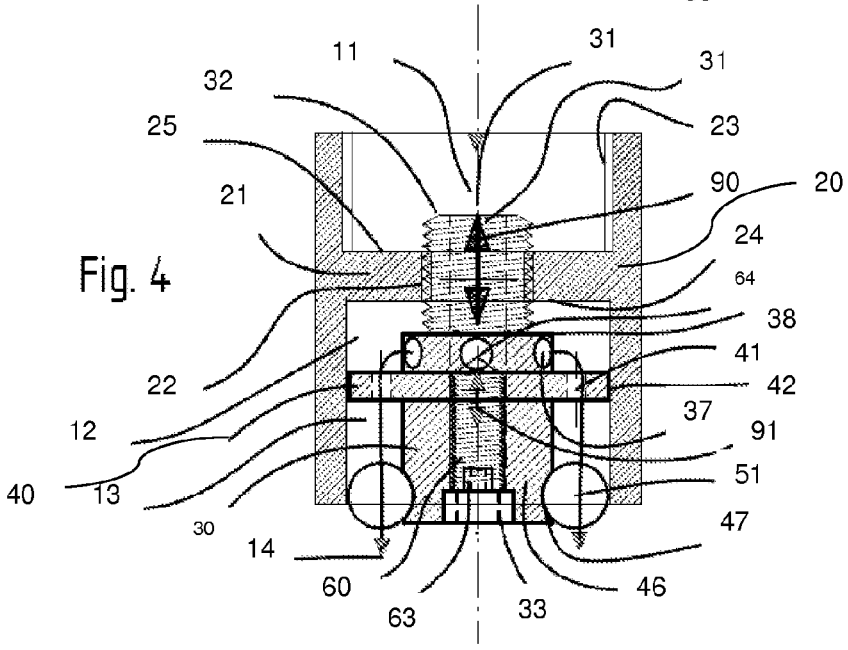
FIG. 4 shows a section similar to that of FIG. 2 through the same embodiment, but in another position.

In the representation in FIG. 4, it can be seen how a rotation of throttling and regulating element 30 is effected relative to sleeve 20. The entire throttling and regulating element 30 with perforate plate 40 has moved down in the direction of arrows 90. If one compares the representation in FIG. 4 with the representation in FIG. 2, distributor space 12 has become clearly larger.

Not shown is a movement along the other indicated arrows 91, which indicate the adjustment possibility of regulating screw 60 inside throttling and regulating element 30. It can be seen that a tip 64 can move into plate 36 and thus change the flow ratios in cross boreholes 37 in this plate.

In a comparison of FIGS. 2 and 4, one also sees that the upper side of plate 36 forms a type of flange 38, which can be moved up in the direction of arrows 90 to the underside 24 of bearing plate 21. Flange 38 forms a stop with underside 24 of bearing plate 21. While in FIG. 2, flange 38 is applied nearly at stop 24, it is disposed at a clearly greater distance in FIG. 4.

In addition to the coarse adjustment, which can be achieved by rotating throttling and regulating element 30 between the positions in FIGS. 2 and 4, the rotation of regulating screw 60 along arrows 91 makes possible a fine regulation, whereby the quantity of water 10 can be continuously adjusted between a minimum and a maximum.

As can be seen particularly in the representation in FIG. 4, a downward movement of the throttling and regulating element makes possible additionally the aspiration of air quantities into the water jet in the region between the inner wall of sleeve 20 and flat spiral spring 51 or by its edge region and the air can be delivered with this jet. This makes possible an optimization of the water jet pattern.

In FIGS. 2 and 4, upper side 25 of bearing plate 21 and a sealing surface 23 are also indicated on the inside of sleeve 20 in the region above bearing plate 21. These surfaces can be made use of for mounting in the water outlet.

Figure 5:
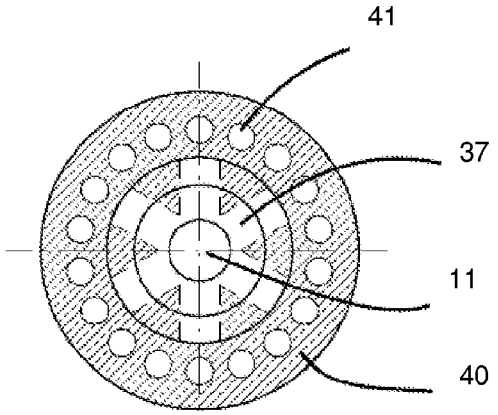
FIG. 5 shows a plan view similar to that of FIG. 1, but for a second embodiment according to the invention.

A view similar to that of FIG. 1 is shown in FIG. 5, but for another, second embodiment of the invention. Again, it is seen that this embodiment also has a water inlet 11, into which water 10 can flow, at first perpendicular to the plane of the figure. Then, a multiple deflection of the direction of flow of water 10 occurs again in other planes located in back of the figure plane, whereby first the water can flow outward through cross boreholes 37 and then the water can flow through circular boreholes 41 in perforate plate 40 again in an axis-parallel manner.

Figure 6:
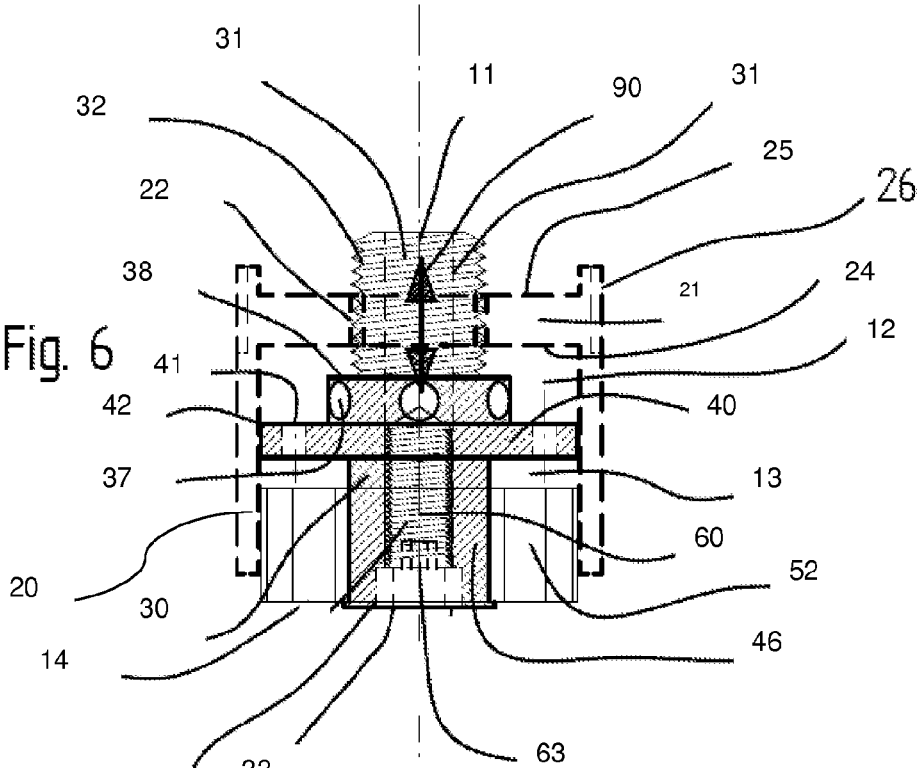
FIG. 6 shows a section similar to that of FIG. 2 through the embodiment of FIG. 5.

The second embodiment of the invention is now shown in greater detail in FIG. 6.

Sleeve 20 with bearing plate 21 is seen here only by dashes. Inner thread 22 in bearing plate 21 again cooperates with outer thread 32 of throttling and regulating element 30. With a relative rotation of throttling and regulating element 30 in sleeve 20, throttling and regulating element 30 moves up and down again in the direction of arrows 90. This movement up and down is limited in turn by flange 38 on the upper side of plate 36 having cross boreholes 37 and stop 24 on the underside of bearing plate 21.

It is indicated in this embodiment that sleeve 20 is equipped with an outer thread 26 in order to be screwed into a water outlet (not shown), for example, of a sanitary fixture.

As in the first embodiment, plate 36 with cross boreholes 37 is found on throttling and regulating element 30, and connecting to this is perforate plate 40 with circular boreholes 41, which are disposed in an axis-parallel and circular manner around the axis, and this perforate plate 40 is guided by guide region 42 at the inner wall of sleeve 20.

The throttling and regulating element continues as cylinder shaft 46 underneath perforate plate 40.

Here also, regulating screw 60 is provided with its hexagon socket 63, by means of which a fine adjustment of the quantity of water 10 can be continuously made from maximum to minimum in this embodiment also.

The adjustment of throttling and regulating element 30 is made by means of hexagon socket 33 at the lower end of cylinder shaft 46. Only one position is shown in the drawing for this embodiment. In this version, flange 38 is not applied to stop 24, so that distributor space 12 is somewhat larger.

The water jet pattern can be optimized by the possibility of adjustment of cylinder shaft 46 in the direction of arrow 90.

Water 10 enters via water inlet 11 into central borehole 31 in throttling and regulating element 30, reaches plate 36 through bearing plate 21, and from here exits into distributor space 12 via the cross boreholes 37 disposed in star-shaped manner. From there, via circular boreholes 41 disposed in a circle in perforate plate 40, it reaches retaining space 13 down to water outlet 14, again in an axis-parallel manner.

Unlike the embodiment of FIGS. 1 to 4, a flat spiral spring 51 is not provided here, but instead there is provided a star 52, which forms water outlet 14 here. Star 52 is a part of a star jet regulator or star aerator and is disposed at a graduation 48 of cylinder shaft 46.

Figure 7:
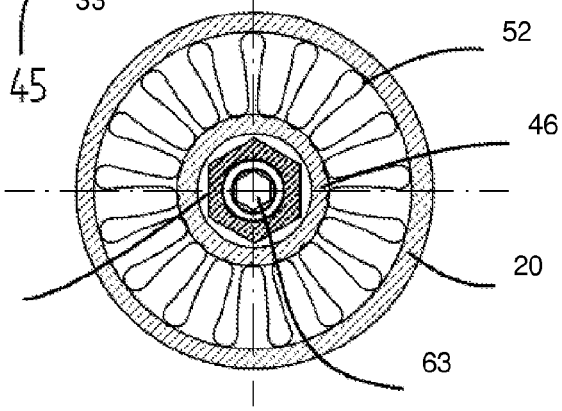
FIG. 7 shows a plan view similar to that of FIG. 3, but on the embodiment of FIGS. 5 and 6.

In turn, FIG. 7 shows a view onto the embodiment of FIGS. 5 and 6, in this case from below, so that the following can be recognized, as seen from the inside to the outside: first hexagon socket 63 of regulating screw 60, then hexagon socket 33 in cylinder shaft 46 and further out, star jet regulator 52. On the very outside, again in annular form, is a view onto the lower edge of sleeve 20.

Figure 8:
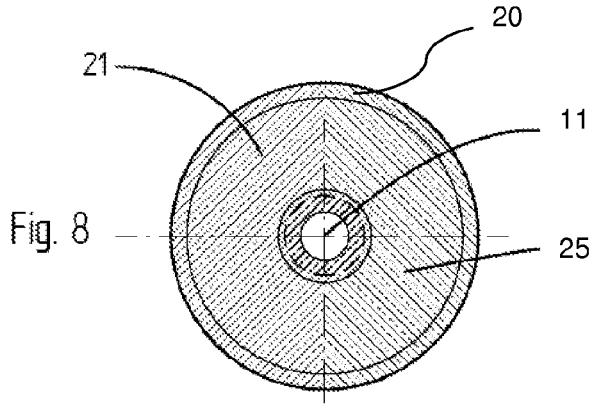
FIG. 8 shows a plan view similar to that of FIG. 1, but on a third embodiment of the invention.

In FIG. 8 is seen, in turn, a representation similar to that of FIGS. 1 and 5, this time as a top view onto a third embodiment of the invention, which is shown in FIGS. 8 to 11.

A sleeve 20 and thus a view onto the upper side 25 of bearing plate 21 can be seen. Inlet opening 11 can be recognized in the center.

Figure 9:
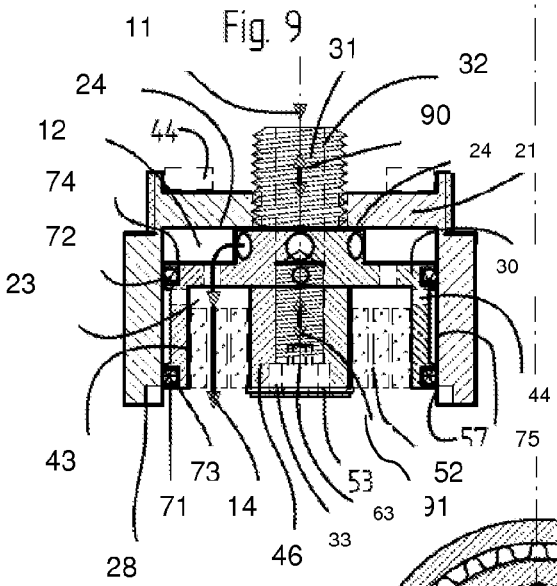
FIG. 9 shows a section similar to that of FIG. 2, but on the third embodiment according to FIG. 8.

FIG. 9 shows a section similar to that of FIGS. 1 and 6. Here also can be seen a sleeve 20 with a bearing plate 21 and an outer thread 26 (compare FIG. 11) for mounting in the water outlet of a sanitary fixture.

Sealing elements 27*, which can be structured here in the form of an O-ring, are indicated by dashes on the upper side 25 of bearing plate 20. These sealing elements are not shown in the other embodiments, but can also be present therein.

*These elements appear to be labeled 44 in FIG. 9—Translator's note.

Disposed in bearing plate 21 with a thread 32 is throttling and regulating element 30 with its central borehole 31, which in turn can be moved up and down with a rotation in the direction of arrows 90.

Again, throttling and regulating element 30 possesses a plate 36 with cross boreholes 37, which is formed in one piece, and underneath this, a perforate plate 40 with axis-parallel circular boreholes 41. Underneath perforate plate 40, throttling and regulating element 30 transitions into a cylinder shaft 46.

Unlike in the embodiments of FIGS. 1 to 7, here also a hollow cylinder 43 is provided proceeding from perforate plate 40.

In the representation of FIG. 9, throttling and regulating element 30 is screwed toward the top by means of hexagon socket 33 and in this way is applied at flange 38 of the plate with cross boreholes 36 to stop 24 on the underside of bearing plate 21.

Also provided, in turn, is regulating screw 60 with its hexagon socket 63, which can be moved upward by rotation in central borehole 31 and can thus be moved up and down along arrow 91.

In distinction from the embodiments in FIGS. 1 to 7, this embodiment is particularly advantageous for the case when an aeration must be completely excluded for hygienic reasons.

For this purpose, hollow cylinder 43 at perforate plate 40 is provided with grooves 71, 72, in which O-rings 73, 74 are found. Also, a recess 75 is provided for the aspiration of air.

Further, a securing ring 53 is disposed here for star jet regulator 52. Here, this may involve a snap ring.

A serration 38* can be recognized at the lower end of sleeve 20. This is formed alternately as a tooth and an empty space, encircling this cylindrical lower end of sleeve 20, as can be very well recognized in FIG. 10.

*sic; serration 28? —Translator's note.

In the representation in FIG. 9, however, another seal of the inner wall of sleeve 20 against the outer side of hollow cylinder 43 in the form of an O-ring 73 in groove 71 is found above serration 28. When it is in the position of the arrangement according to FIG. 9, serration 28 is disabled. Serration 28, of course, can also serve as an engagement for a mounting tool, in order to be able to mount sleeve 20 and thus the system according to the invention in the water outlet of a sanitary fixture.

In this embodiment, water 10 also enters into central borehole 31 of throttling and regulating element 30 via water inlet 11. It reaches in turn the region of plate 36 and there enters a distributor space 12 via cross boreholes 37. This distributor space 12 acts as a pressure chamber here. It exits the pressure chamber of distributor space 12 through boreholes 41 disposed in a circle in perforate plate 40 into retaining space 13, which is structured as the mixing chamber. From retaining space 13, the water then exits through star 52 as water outlet 14.

A view of sleeve 20 and the other elements from the embodiment in FIGS. 8 and 9 are shown from below in FIG. 10.

Again, on the inside, one sees hexagon socket 63 of regulating screw 60 and disposed around this, hexagon socket 33 of throttling and regulating element 30 with its cylinder shaft 46.

Disposed around this can be seen star jet regulator 52, from which water flows here in the direction of the observer, as water outlet 14. This region in turn is annularly encircled by the lower edge of hollow cylinder 43, which extends from perforate plate 40 to the observer. This element is also joined in one piece with throttling and regulating element 30 in the embodiment shown.

Around this annular element can be seen serration 28, thus a partial graduation of the inside lower edge of sleeve 20, the further region of which is seen in the next ring.

Figure 11:
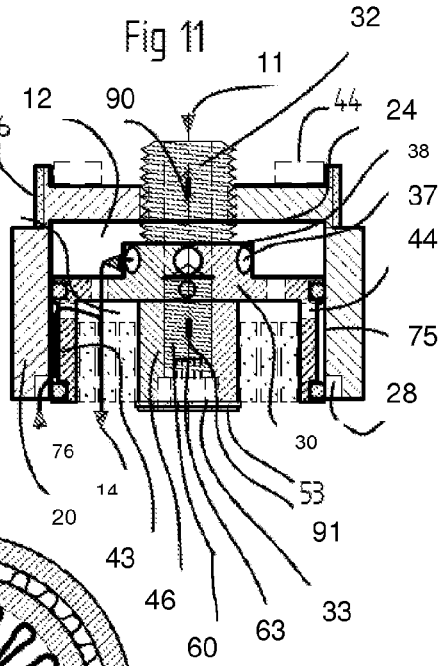
FIG. 11 shows a section similar to that of FIG. 9 through the same embodiment, but in another position.
Figure 10:
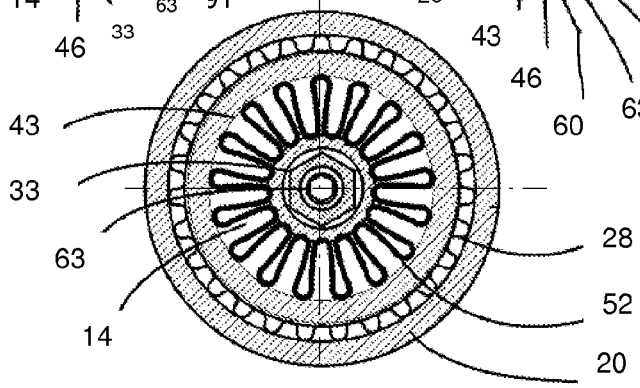
FIG. 10 shows a plan view similar to that of FIG. 3, but on the third embodiment of FIGS. 8 and 9.

In FIG. 11 is seen the embodiment of FIGS. 8 to 10, this time, in turn, in a position, in which throttling and regulating element 30 with its other elements is moved downward, thus similar to the representation in FIGS. 4 and 7.

Thus, one sees again sleeve 20 with its outer thread 26 for mounting on a water outlet of a sanitary fixture. Serration 28 can also be recognized again at the lower end of sleeve 20.

In sleeve 20 is found throttling and regulating element 30 having plate 36 with cross boreholes 37 in star formation as well as perforate plate 40. Hollow cylinder 43 with grooves 71 and 72 as well as O-rings 73 and 74 disposed therein extend from perforate plate 40 in an axis-parallel manner. Between the two grooves 71 and 72 is found, in turn, recess 75 for an air intake in this position, which will be explained in more detail.

In turn, one also recognizes star jet regulator 52 with its securing ring 53.

Regulating screw 60 with its hexagon socket 63 can also be seen here.

Throttling and regulating element 30 in this position is not rotated with flange 38 of plate 36 up to stop 24 at the underside of bearing plate 21.

This leads to the circumstance that now the lower end of hollow cylinder 43 no longer seals about and against the inner wall of sleeve 20 with groove 71 and O-ring 73 found therein (compare FIG. 9), but is applied in the region of serration 28.

In the sectional position shown, it can thus be seen that air from outside of sleeve 20 can enter into recess 75 between the two grooves 71 and 72 in the outer wall of hollow cylinder 43, through the spaces between teeth, thus through the gaps between every two teeth of serration 28 that are present here. This aeration 76 cannot occur in the position of FIG. 9.

In hollow cylinder 43 are found radially running boreholes 44, which are also present in the representation of FIG. 9, but have no function there. The aeration 76 can thus now enter into the hollow cylinder through the gaps in the teeth of serration 28, recess 75 in the outer wall of hollow cylinder 43 and through the radially running boreholes 44 in the hollow cylinder and there, in fact, into retaining space 13, which forms a mixing chamber here, as already mentioned above in connection with FIG. 9, i.e., for the aeration 76 with water 10 entering through circular boreholes 41 from perforate plate 40.

In this position, thus considered overall, water 10 enters via water inlet 11 into central borehole 31 in throttling and regulating element 30 and flows through this element in the representation down to plate 36, where it is stopped by regulating screw 60 screwed in from below and flows through cross boreholes 37 in star formation radially outward into distributor space 12, which forms the pressure chamber here. From distributor space 12, water 10 then flows through axis-parallel circular boreholes 41 in perforate plate 40 into retaining space 13, which forms a mixing chamber here, in which the water is mixed with air for aeration 76 that flows in through radial boreholes 44. The water/air mixture then exits through star jet regulator 52 as water outlet 14.

In this embodiment, it is now possible, on the one hand, to continuously finely adjust the water quantity from a maximum to a minimum, by adjusting regulating screw 60 in the direction of arrow 91 and, on the other hand, to obtain a continuous adjustment and reduction of aeration 76 relative to the quantity of water 10 that is flowing in by a rotation and thus an adjustment of throttling and regulating element 30 relative to sleeve 20 in the direction of arrow 90.

In this embodiment, the installer can thus determine in general whether an aeration 76 will occur or not and at the same time, how intense this aeration will be, by the rotation of throttling and regulating element 30 by means of hexagon socket 33.

This particularly has the effect that this embodiment can be used both when an aeration must not occur for hygienic reasons or for legal requirements, e.g., in hospitals, and when this aeration is desired, e.g., in hotels and restaurants.

It is thus no longer necessary to design and keep in stock different embodiments for these very different and mutually exclusive application purposes. Thus, one and the same embodiment can be used for two application objectives and an adaptation to each desired case of application can be undertaken simply by a corresponding adjustment of throttling and regulating element 30.

Therefore, it can be assured by serration 28 and a tool especially adapted for this serration 28 that a misuse or confusion by unauthorized persons cannot occur.

Figure 12:
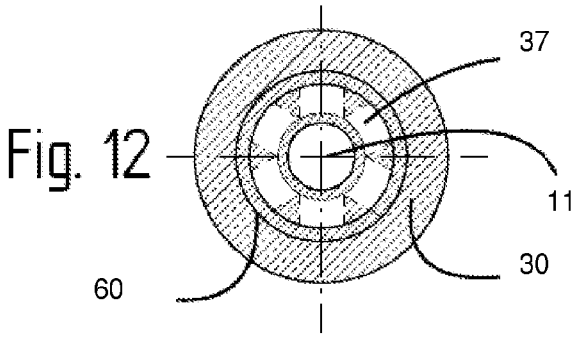
FIG. 12 shows a plan view similar to that of FIG. 1, but on a fourth embodiment of the invention.

A fourth embodiment of the invention is shown in FIG. 12. Again, the view is from an axial end of an arrangement according to the invention in the direction of flow of water 10 onto water inlet 11. Water inlet 11 leads into central borehole 31 of throttling and regulating element 30, of which the upper edge can be seen here, and in this, one can see onto plate 36 with cross boreholes 37.

Figure 13:
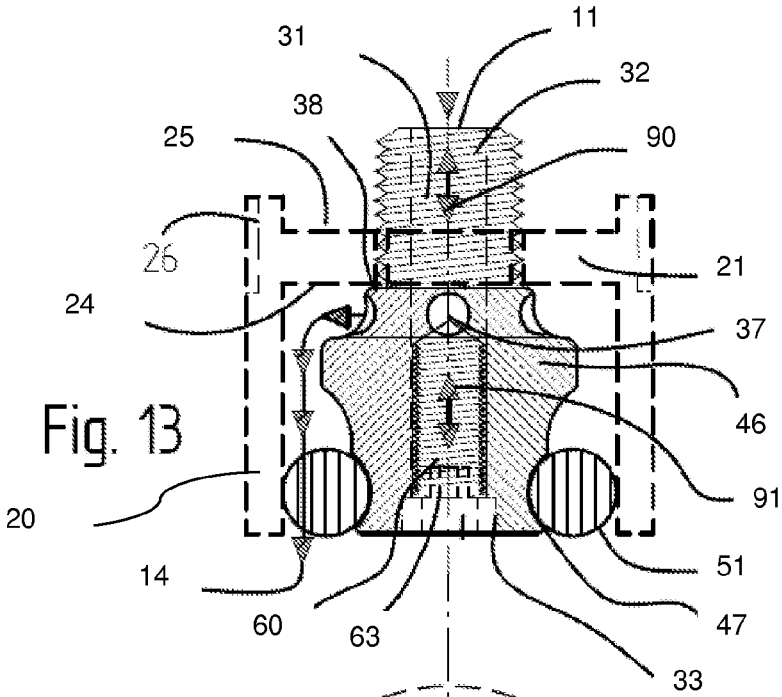
FIG. 13 shows a view similar to that of FIG. 2, but through the fourth embodiment of the invention according to FIG. 12.

A section along the axis of the arrangement according to the invention similar to the representation of FIG. 6 is shown in FIG. 13. Sleeve 20 with its outer thread 26 and bearing plate 21 can be recognized by the dashes. The underside 24 and the upper side 25 of bearing plate 21 are also seen.

Throttling and regulating element 30 with axially running central borehole 31 and outer thread 32 project through bearing plate 21.

Underneath bearing plate 21, throttling and regulating element 30 first expands to plate 36 with cross boreholes 37 and then, instead of a perforate plate, directly transitions into a cylinder shaft 46 with a circular groove 47 for taking up a flat spiral spring 51.

The cylinder shaft is again provided with a hexagon socket 33 on the bottom, in order to be able to be rotated around the axis relative to bearing plate 21.

A regulating screw 60, which can be rotated by means of engaging a tool in a hexagon socket 63 relative to cylinder shaft 46, in turn projects into central borehole 31 from below. Regulating screw 60 can be moved up and down by this rotation in the direction of arrow 91 and in this way projects more or less deeply into plate 36 with cross boreholes 37.

In turn, a position is shown, in which flange 38 at the upper side of plate 36 is applied at a stop directly at underside 24 of bearing plate 21.

Water 10 enters into water inlet 11 and from there into central borehole 31 in throttling and regulating element 30. It flows down to the tip of regulating screw 60 and is thereby redirected into cross boreholes 37 at a right angle. It then flows between the outer wall of cylinder shaft 46 and the inner wall of sleeve 20 downward through flat spiral spring 51 through water outlet 14.

This version makes possible an optimization of the water jet pattern due to the corresponding rotation of throttling and regulating element 30 by means of hexagon socket 33 in the representation in FIG. 13 counterclockwise of thread 32. An adjustment of the water quantity from maximum to minimum can be made continuously by adjusting regulating screw 60. In this embodiment, considerable quantities of air can be aspirated into the flowing water.

Figure 14:
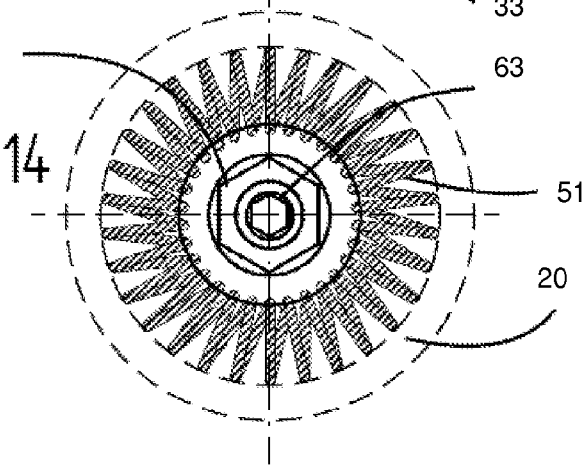
FIG. 14 shows a plan view similar to that of FIG. 3, but on the fourth embodiment of the invention according to FIG. 13.

FIG. 14 shows in turn a view onto the embodiment of FIGS. 12 and 13, in this case, from below, so that the following can be recognized, viewed from inside to outside: first, hexagon socket 63 of regulating screw 60, then hexagon socket 33 in cylinder shaft 46 and further outward, flat spiral spring 51 in its annular state around cylinder shaft 46. A view onto the lower edge of sleeve 20 can be recognized at the very outside, in this case by the ring of dashes.

Figure 15:
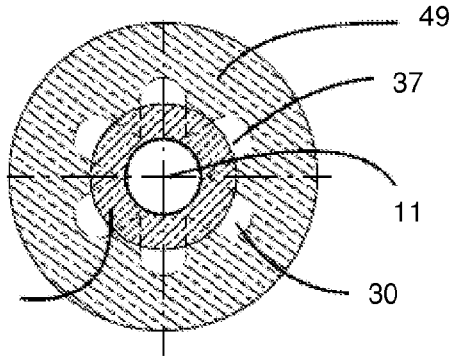
FIG. 15 shows a plan view similar to that of FIG. 1, but on a fifth embodiment of the invention.

FIG. 15 shows a fifth embodiment of the invention. The view is again from an axial end onto water inlet 11 in the flow direction of water 10. The water then flows perpendicular to the plane of the figure through the upper section of the throttling and regulating element with outer thread 32 and is then radially redirected outwardly into cross boreholes 37 behind the plane of the page.

It is also seen in FIG. 15 that another widening of throttling and regulating element 30 moves into the viewing field.

Figure 16:
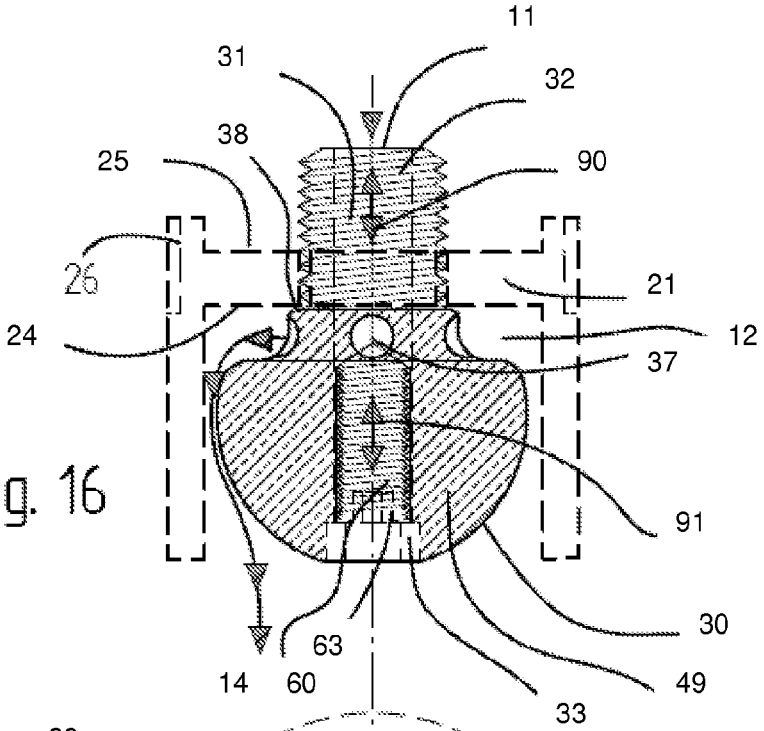
FIG. 16 shows a view similar to that of FIG. 2, but through the fifth embodiment of the invention according to FIG. 15.

The fifth embodiment of the invention can be better recognized in FIG. 16 in a section along the axis. Sleeve 20 with its outer thread 26 and bearing plate 21 can be recognized by the dashes as in FIG. 13. The underside 24 and the upper side 25 of bearing plate 21 are also seen.

Throttling and regulating element 30 with axially running central borehole 31 and outer thread 32 projects through bearing plate 21.

Underneath bearing plate 21, throttling and regulating element 30 first widens to the plate 36 having cross boreholes.

Underneath plate 36 with cross boreholes 37, a perforate plate is not provided in the embodiment in FIG. 16, just as in the embodiment of FIG. 13. In this embodiment, however, the throttling and regulating element widens almost completely up to the inner wall of sleeve 20, in order to again taper in the downward direction parallel to the axis. Overall, this region of throttling and regulating element 30 in this case does not assume a shape similar to a cylinder shaft, but forms a type of hemisphere 49 with rounded shape.

This hemisphere 49 is in turn provided with a hexagon socket 33 on the bottom, in order to be able to be rotated around the axis relative to bearing plate 21.

A regulating screw 60, which can be rotated by means of engaging a tool in a hexagon socket 63 relative to hemisphere 49, projects into central borehole 31 from below. Regulating screw 60 can be moved up and down by this rotation in the direction of arrow 91 and in this way projects more or less deeply into plate 36 with cross boreholes 37.

In turn, a position is shown, in which flange 38 at the upper surface of plate 36 is applied as a stop directly to underside 24 of bearing plate 21.

Water 10 enters into water inlet 11 and from there into central borehole 31 in throttling and regulating element 30. It flows down to the tip of regulating screw 60 and is thereby redirected into cross boreholes 37 at a right angle. It then flows between the outer wall of hollow sphere 49* and the inner wall of sleeve 20 downward through water outlet 14.

*sic; hemisphere 49? —Translator's note.

In this fifth embodiment, a water jet without aeration is formed at water outlet 14. The shape of element 49 together with the surrounding sleeve 20 leads to the circumstance that water 10 flowing between hollow sphere 49* and the inner wall of sleeve 20 is bundled toward the axis, particularly also due to the lack of aeration. A particularly smooth jet is formed here, which is particularly desired, for example, when taking water for drinking or when filling containers. Such a jet can be particularly well estimated for the user, in particular as far as the rate of filling of containers or similar purposes is concerned.

Figure 17:
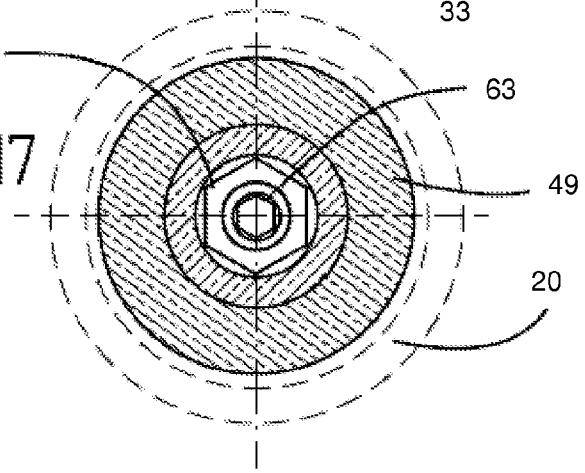
FIG. 17 shows a plan view similar to that of FIG. 3, but on the fifth embodiment of the invention according to FIG. 16.

This embodiment is shown from below in FIG. 17. From outside to inside: sleeve 20, hemisphere 49 of throttling and regulating element 30 therein, further inside hexagon socket 33 in hemisphere 49, and still further inside hexagon socket 63 in regulating screw 60.

An adjustment of the water quantity from a maximum to a minimum can be made continuously by adjusting regulating screw 60. The water jet pattern can be optimized by a rotation of throttling and regulating element 30 by means of engaging a tool in hexagon socket 33 counterclockwise.

Figure 18:
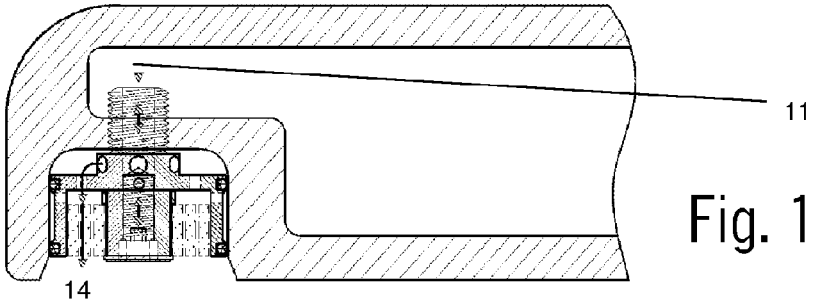
FIG. 18 shows a fixture in section containing a regulating device according to the invention in a sixth embodiment.

The outlet of a fixture is shown in FIG. 18. The water would be introduced from the right side as seen in FIG. 18. In this representation, an embodiment of a regulating device according to the invention is seen for a water outlet that is utilized in the region shown such that a movement up and down is produced by rotation of throttling and regulating element 30 and thus it is possible to influence the flowing water.

Figure 19:
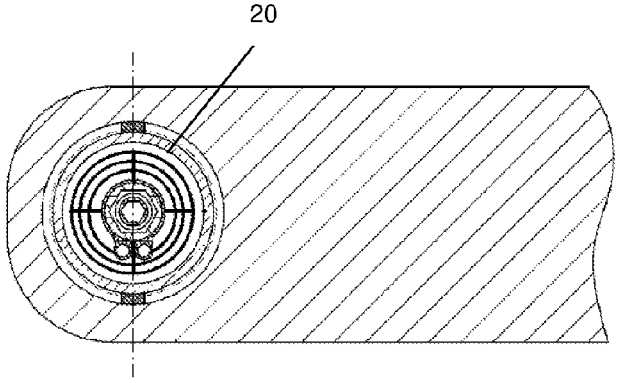
FIG. 19 shows a view onto the design of FIG. 18 from below.

The embodiment of FIG. 18 is seen in FIG. 19, and in fact, viewed from below. The view is thus onto the surface of the outlet region of a fixture and mounted sleeve 20 as well as throttling and regulating element 30 therein from below.

For the observer in front of the throttling and regulating element an annular insert 81 is seen, which will be explained in more detail in FIG. 22.

Figure 20:
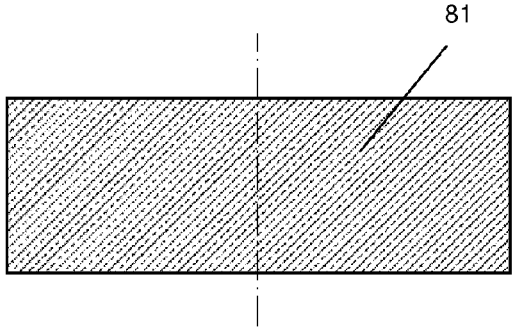
FIG. 20 shows a detail from the embodiment in FIG. 19 in lateral view.

A view of this annular insert 81 from the side can be recognized in FIG. 20.

Figure 21:
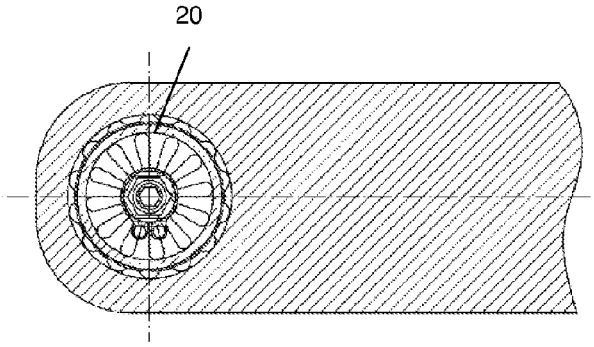
FIG. 21 shows a view corresponding to FIG. 19 after dismantling the annular insert.

The embodiment of FIG. 19 is shown in FIG. 21, with the omission of annular insert 81 for clarification.

Figure 22:
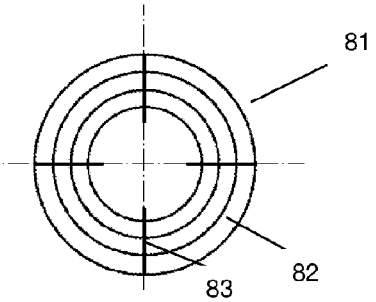
FIG. 22 shows an annular insert for changing the view of FIG. 21 to the view of FIG. 19.

A separate representation of annular insert 81 is reproduced in FIG. 22. Annular insert 81 comprises several cylindrical rings 82, which are joined with one another by crosspieces 83.

Inside, crosspieces 83 project over the innermost ring 82 in the direction toward the center. In this way, a secure fastening can be assured by annular insert 81, which functions as a type of securing ring.

Rings 82 and also optionally crosspieces 83 preferably comprise a ceramic material, for example polymers, or even pure silver. These types of annular inserts 81 are particularly used in hygienically sensitive fields, for example, in operating rooms, intensive care units or nurseries for newborns.

Figure 23:
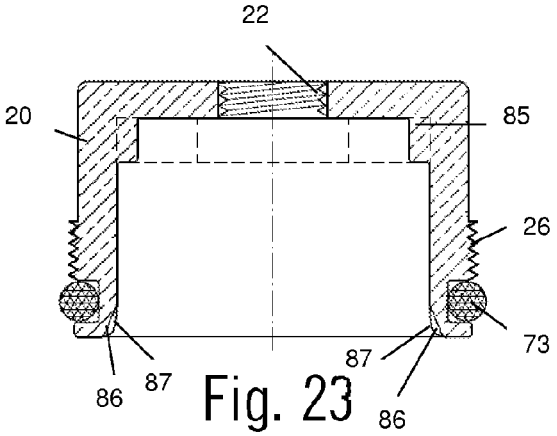
FIG. 23 shows an adapter sleeve for retrofitting in fittings.

A sleeve 20 in the form of an adapter sleeve is shown in section in FIG. 23. This sleeve has an inner hexagon 85. Sleeve 20 can be mounted or dismantled with the help of hexagon 85 by means of a hexagon wrench, thus a so-called Allen wrench, in the outlet of the fixture, e.g., in embodiments according to FIGS. 18, 19 and 21.

This form of a sleeve 20 therefore serves as an adapter in fittings, in which a regulating device according to the invention is to be retrofitted, thus, for example, when a regulating possibility for both the air component as well as the water component is to be retrofitted later. The advantage in this embodiment, among other things, is that a crown-shaped serration, like in several of the preceeding embodiments, is not necessary. This means that less surface which might serve as the basis for contamination is present.

In addition, a bevel 86 and/or a serration 87 can be provided in the opening region.

A borehole with inner thread 22 is found in the center of sleeve 20. Throttling and regulating element 30, which is not reproduced in FIG. 23, can be screwed into this inner thread 22

An O-ring 73 and an outer thread 26 for sealing and fastening are provided in the outlet region of the fixture from FIGS. 18, 19 and 21.

A representation of sleeve 20 from FIG. 23, which is seen from below, is found in FIG. 24. A view onto hexagon 85 and the borehole with inner thread 22 is seen.

Further, serration 87 can be recognized.

Figure 24:
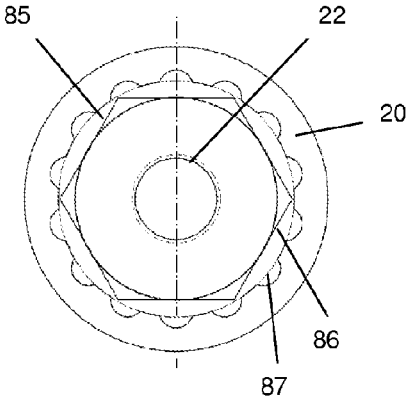
FIG. 24 shows the representation of FIG. 23 seen from below.
Figure 25:
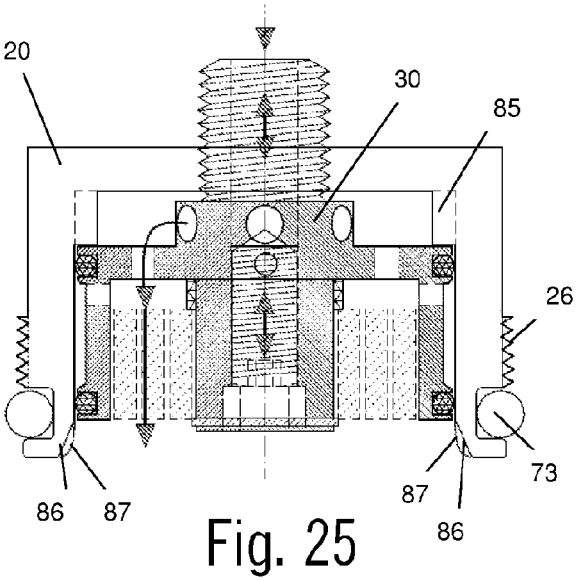
FIG. 25 shows an enlarged representation of the sleeve from FIG. 23 containing the regulating element from FIG. 18.

In FIG. 25, it is now shown how a throttling and regulating element 30 is inserted into a sleeve 20, e.g., from FIGS. 23 and 24.

Hexagon 85 can still be recognized, and it is seen that bevel 86 and serration 87 can be utilized for a particularly precise and accurate regulation of the air component. Here, reference is made to the description for the embodiment in FIGS. 9, 10 and 11, the functionality of which is similar in this respect.

Figure 26:
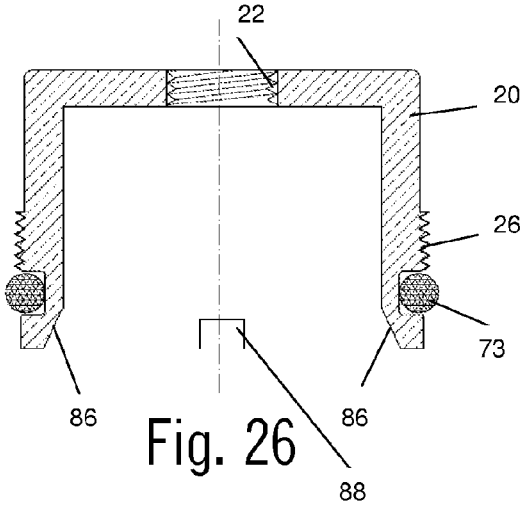
FIG. 26 shows a sleeve similar to that in FIG. 23, but in a variant design.

An embodiment of a sleeve 20 is shown in FIG. 26, which is similar to the embodiment of FIG. 23. Here, a hexagon 85 is not provided for mounting into the outlet of a fixture, but instead of this, a slot 88 is provided in the lower peripheral edge of sleeve 20. In turn, outer thread 26 with O-ring 73 and inner thread 22 of the borehole for piercing throttling and regulating element 30 from FIG. 25 can be recognized.

Bevel 86 can be recognized on both sides here.

Figure 27:
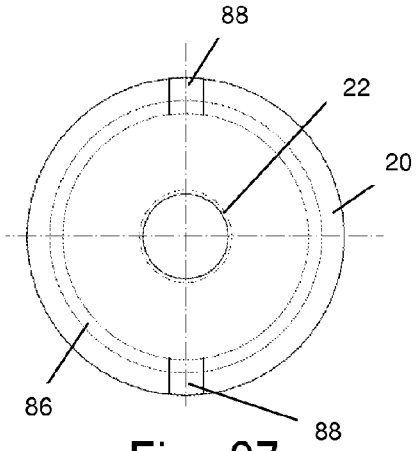
FIG. 27 shows a view of the embodiment of FIG. 26 from below.

FIG. 27 shows a view of the embodiment of FIG. 26 from below. Here, slot 88 for taking up a screwdriver blade can be particularly well seen.

Also, bevel 86 can be recognized in its circular configuration.

LIST OF REFERENCE SYMBOLS

10 Water
11 Water inlet
12 Distributor space
13 Retaining space
14 Water outlet
20 Sleeve
21 Bearing plate in the sleeve
22 Inner thread in the bearing plate
23 Sealing surface of the sleeve
24 Stop, underside of bearing plate 21
25 Upper side of the bearing plate
26 Outer thread of sleeve 20
27 Sealing elements on upper side 25
28 Serration
30 Throttling and regulating element
31 Central borehole in the throttling and regulating element
32 Outer thread of the throttling and regulating element
33 Hexagon socket of the throttling and regulating element

36 Plate with cross boreholes
37 Cross boreholes in star formation in plate 36
38 Flange, upper side of plate 36
40 Perforate plate
41 Circular boreholes in the perforate plate
42 Guide region
43 Hollow cylinder
44 Boreholes in radial direction
46 Cylinder shaft with circular groove or graduation
47 Circular groove in the cylinder shaft
48 Graduation on the cylinder shaft for star jet regulator 52
49 Hemisphere
51 Flat spiral spring
52 Star or star jet regulator
53 Securing ring
60 Regulating screw
63 Hexagon socket of regulating screw 60
64 Tip of regulating screw 60
71 Groove
72 Groove
73 O-ring
74 O-ring
75 Recess in the outer wall of hollow cylinder 43
76 Aeration
81 Annular insert
82 Rings
83 Crosspieces
85 Inner hexagon of sleeve 20
86 Bevel on sleeve 20
87 Serration on sleeve 20
88 Slot 88
90 Arrow, which indicates the possible movement of element 30
91 Arrow, which indicates the possible movement of regulating screw 60

What is claimed is:

1. A regulating device for a water outflow, comprising:

a cylindrical sleeve with a central axis, said cylindrical sleeve is for introducing the water outflow at a water inlet opening, a bearing plate disposed within the cylindrical sleeve and perpendicular to the axis of the sleeve, a throttling and regulating element that can rotate around the axis relative to the bearing plate and move in the direction of the axis, and through which water can flow from one side of the bearing plate to the other side of the bearing plate, an annular distributor space for water, which space is defined between the bearing plate, sleeve and throttling and regulating element, and into which water can flow from the cylindrical sleeve to a water outlet, said bearing plate having a through borehole extending in a direction of the central axis of the sleeve with an inner thread, said throttling and regulating element having an outer thread so that when the outer threads of the throttling and regulating element are engaged with the inner threads of the through borehole of the bearing plate, a rotation of the throttling and regulating element around the central axis of the sleeve leads to a movement of the throttling and regulating element in the direction of the central axis and relative to the sleeve, said throttling and regulating element having a threaded center bore extending in the direction of said center axis, and at least one cross borehole disposed underneath the outer threads of the throttling and regulating element, wherein a device for the fine throttling of water includes a regulating screw having outer threads which are screwed into the threaded center bore of the throttling and regulating element, and which regulating screw is adjustable so as to finely adjust the flow of water into the distributor space, said at least one cross bore in said throttling and regulating element extending transverse to said central axis for water communication from the water inlet opening to the distributor space, said regulating screw adjustable relative to the throttling and regulating element and including a tip thereof engaging the at least one cross borehole to thus change the flow ratio in the at least one cross borehole for fine adjustment of water flow, and a mechanism for metering an additional amount of air into the water jet at the water outlet by moving the throttling and regulating element in the axial direction relative to the cylindrical sleeve.

2. The regulating device for a water outflow according to claim 1, further characterized in that the device for the fine throttling of water is provided underneath cross boreholes in a star formation, and in that when a throttling occurs by means of the device, cross boreholes introduced directly above a perforate plate are closed.

3. The regulating device for a water outflow according to claim 1, further characterized in that the bearing plate is formed in one piece with the cylindrical sleeve.

4. The regulating device for a water outflow according to claim 1, further characterized in that the bearing plate is equipped with a through borehole with an inner thread, and in that the throttling and regulating element with an outer thread is inserted into the inner thread of the bearing plate, so that a rotation of the throttling and regulating element around the axis of the sleeve leads to a movement in the direction of the axis.

5. The regulating device for a water outflow according to claim 1, further characterized in that a perforate plate is disposed parallel to the bearing plate at the throttling and regulating element, in that the perforate plate extends almost to the inner walls of the sleeve, in that the perforate plate is furnished with one or more through boreholes, in that the distributor space is disposed between the bearing plate and the perforate plate, and in that water flows out from the distributor space through the boreholes in the perforate plate.

6. The regulating device for a water outflow according to claim 5, further characterized in that the perforate plate is designed in one piece with the throttling and regulating element.

7. The regulating device for a water outflow according to claim 1, further characterized in that the throttling and regulating element is equipped with cross boreholes in a star formation, and in that the cross boreholes in the star formation run perpendicular to the axis of the sleeve and lead into the distributor space from the inner region of the throttling and regulating element.

8. The regulating device for a water outflow according to claim 1, further characterized in that the distributor space is disposed and constructed such that its volume changes along the axis when the throttling and regulating element is adjusted, so that the properties of the water jet are changed.

9. The regulating device for a water outflow according to claim 5, further characterized in that the throttling device can be rotated around the axis of the throttling and regulating element by means of a hexagon socket and in this way can be moved along in the axial direction within the central borehole.

10. The regulating device for a water outflow according to claim 1, further characterized in that the water outlet from the sleeve is provided by a spiral spring disposed annularly around the axis.

11. The regulating device for a water outflow according to claim 1, further characterized in that, on its lower end, the throttling and regulating element has a hexagon socket, by means of which hexagon socket, a rotation of the throttling and regulating element is made possible relative to the bearing plate.

12. The regulating device for a water outflow according to claim 1 including an annular spring that is disposed between the throttling and regulating element and the cylindrical sleeve at a base of the cylindrical sleeve so that a downward movement of the throttling and regulating element provides as aspiration of air quantities into the water jet in the region between the inner wall of sleeve and the annular spiral spring or by its edge region and thus the air is delivered with this water jet.

13. The regulating device for a water outflow according to claim 1 wherein the throttling and regulating element is provided with multiple cross boreholes in a star formation, and the cross boreholes in the star formation run perpendicular to the axis of the sleeve and lead into the distributor space from an inner region of the throttling and regulating element.

14. The regulating device for a water outflow according to claim 13 further including a perforate plate that is constructed and arranged to be disposed parallel to the bearing plate at the throttling and regulating element, the perforate plate extending toward the inner walls of the sleeve, the perforate plate having one or more through boreholes, the distributor space is disposed between the bearing plate and the perforate plate, and wherein water flows out from the distributor space through the boreholes in the perforate plate.

15. The regulating device for a water outflow according to claim 14 wherein the perforate plate is planar and extends substantially orthogonal to the central axis of the cylindrical sleeve, said perforate plate also including, integral therewith, a hollow cylinder member that extends toward the water outlet and that defines with the cylindrical sleeve a recess that is provided for the aspiration of air.

16. The regulating device for a water outflow according to claim 15 wherein the hollow cylindrical member has a center axis coincident with the central axis of the cylindrical sleeve, the hollow cylinder member has a series of radially extending boreholes, the perforate plate defines therebelow a retaining space, and the aeration now enters into the hollow cylinder through the recess at the outer wall of hollow cylinder and through the radially extending holes in the hollow cylinder member into the retaining space.

17. The regulating device for a water outflow according to claim 16 wherein the control is such that there is a continuous fine adjust of the water quantity from a maximum to a minimum, by adjusting the regulating screw in the direction of the central axis and, on the other hand, to obtain a continuous adjustment and reduction of aeration relative to the quantity of water that is flowing in by a rotation and thus an adjustment of the throttling and regulating element relative to sleeve in the direction of the central axis.

18. The regulating device for a water outflow according to claim 17 including an annular spring that is disposed between the throttling and regulating element and the cylindrical sleeve at a base of the cylindrical sleeve so that a downward movement of the throttling and regulating element provides as aspiration of air quantities into the water jet in the region between the inner wall of sleeve and the annular spiral spring or by its edge region and thus the air is delivered with this water jet, wherein the boreholes in the hollow cylinder member extend substantially orthogonal to the boreholes in the perforate plate and air is metered through the boreholes in the hollow cylinder member.

* * * * *